US008358091B2

(12) United States Patent
Strauss et al.

(10) Patent No.: US 8,358,091 B2
(45) Date of Patent: Jan. 22, 2013

(54) APPARATUS AND METHOD FOR GENERATING A NUMBER OF LOUDSPEAKER SIGNALS FOR A LOUDSPEAKER ARRAY WHICH DEFINES A REPRODUCTION SPACE

(75) Inventors: Michael Strauss, Ilmenau (DE); Thomas Hoernlein, Hildesheim (DE)

(73) Assignee: Fraunhofer-Gesellschaft zur Foerderung der Angewandten Forschung e.V., Munich (DE)

( * ) Notice: Subject to any disclaimer, the term of this patent is extended or adjusted under 35 U.S.C. 154(b) by 925 days.

(21) Appl. No.: 12/445,150

(22) PCT Filed: Oct. 10, 2007

(86) PCT No.: PCT/EP2007/008823

§ 371 (c)(1),
(2), (4) Date: May 12, 2009

(87) PCT Pub. No.: WO2008/043549

PCT Pub. Date: Apr. 17, 2008

(65) Prior Publication Data

US 2010/0092014 A1 Apr. 15, 2010

(30) Foreign Application Priority Data

Oct. 11, 2006 (DE) ..... 10 2006 048 205
Nov. 15, 2006 (DE) ..... 10 2006 053 919

(51) Int. Cl.
*H04R 5/02* (2006.01)

(52) U.S. Cl. ..... 318/300; 381/310

(58) Field of Classification Search ..... 381/300–310
See application file for complete search history.

(56) References Cited

U.S. PATENT DOCUMENTS

| | | | | |
|---|---|---|---|---|
| 6,574,995 | B2 | 6/2003 | Sauter et al. | |
| 7,706,544 | B2 * | 4/2010 | Melchior et al. | 381/310 |
| 2002/0152774 | A1 | 10/2002 | Sauter et al. | |
| 2006/0098830 | A1 * | 5/2006 | Roeder et al. | 381/310 |
| 2009/0220111 | A1 * | 9/2009 | Deguara et al. | 381/300 |

FOREIGN PATENT DOCUMENTS

DE 10 2004 002 532 A1 9/2005

(Continued)

OTHER PUBLICATIONS

Official Communication issued in International Patent Application No. PCT/EP2007/008823, mailed on May 5, 2009.

(Continued)

*Primary Examiner* — Cuong Q Nguyen
(74) *Attorney, Agent, or Firm* — Keating & Bennett, LLP

(57) ABSTRACT

An apparatus for generating a number of loudspeaker signals for a loudspeaker array defining a reproduction space includes a prestage configured to generate a plurality of output audio signals while using one or more audio signals associated with one or more virtual positions, each output audio signal being associated to a loudspeaker position such that the plurality of output audio signals together replicate a reproduction of the input audio signal(s) at the virtual position(s), and a number of output audio signals being smaller than a number of loudspeaker signals. The apparatus further includes a main stage configured to obtain the plurality of output audio signals and further to obtain, as a virtual position for each output audio signal, the loudspeaker positions, and to generate the number of loudspeaker signals for the loudspeaker array such that the loudspeaker positions are replicated as a virtual sources by the loudspeaker array.

16 Claims, 4 Drawing Sheets

FOREIGN PATENT DOCUMENTS

| | | | |
|---|---|---|---|
| JP | 10-174199 | A | 6/1998 |
| JP | 2002-186100 | A | 6/2002 |
| JP | 2006-507727 | A | 3/2006 |
| JP | 2007-507121 | A | 3/2007 |
| WO | 02/08506 | A1 | 1/2002 |
| WO | 2004/047485 | A1 | 6/2004 |
| WO | 2004/114725 | A1 | 12/2004 |
| WO | 2005/015954 | A2 | 2/2005 |
| WO | 2005/060307 | A1 | 6/2005 |
| WO | 2008/043549 | A1 | 4/2008 |

OTHER PUBLICATIONS

Official Communication issued in corresponding Japanese Patent Application No. 2009-531771, mailed on Feb. 8, 2011.

Dewhirst et al.: "Objective Assessment of Spatial Localisation Attributes of Surround-Sound Reproduction Systems," Audio Engineering Society Convention Paper 6441; Presented at the 118th Covention; May 28-31, 2005; pp. 1-16.

Sontacchi et al.: "Further Investigations on 3D Sound Fields Using Distance Coding," Proceedings of the COST G-6 Conference on Digital Audio Effects (DAFX-01); Dec. 6-8, 2001; pp. 1-3.

Daniel et al.; "Further Study of Sound Field Coding With High Order Ambisonics," Audio Engineering Society Convention Paper; Presented at the 116th Convention; May 8-11, 2004; pp. 1-14.

Theile et al.: "Wellenfeldsynthese Neue Moeglichkeiten Der Raeumlichen Tonaufnahme Und Wiedergabe—Teil II," Fermseh-Und Kino-Technik; XP001218258; Bd. 57, Nr. 6; Jun. 2003; pp. 282-285.

Official communication issued in counterpart International Application No. PCT/EP2007/008823, mailed on Jan. 30, 2008.

English translation of the official communication issued in counterpart German Application No. 10 2006 053 919.2, mailed on Sep. 18, 2007.

* cited by examiner

APPARATUS AND METHOD FOR GENERATING A NUMBER OF LOUDSPEAKER SIGNALS FOR A LOUDSPEAKER ARRAY WHICH DEFINES A REPRODUCTION SPACE

The present invention relates to the reproduction of spatial audio signals as occur, for example, in the reproduction of film material, concerts, or in the field of computer and video games.

BACKGROUND OF THE INVENTION

In the field of spatial audio reproduction, several methods have been known in conventional technology, including, for example, wave field synthesis, the fundamental idea of which is based on Huygens' principle according to which any point at which a wave arrives is a starting point of an elementary wave propagating in a spherical or circular manner. Wave field synthesis is employed in acoustics on the basis of a large number of loudspeakers arranged adjacent to one another, a so-called loudspeaker array, and is able, in principle, to replicate any shape of an incoming wave front. In the simplest case, the case of a single point source to be reproduced and a linear arrangement of the loudspeakers, the audio signals of any loudspeaker may be filtered, using a time delay and amplitude scaling, such that a corresponding spatial impression results for a listener, the radiated sound fields of the individual loudspeakers superimposing accordingly. If there are several sound sources, the contribution to each loudspeaker is calculated separately for each source, and the resulting signals are added. If the sources to be reproduced are located within a room having reflecting walls, reflections may possibly be compensated for via respective filters using the loudspeaker array.

The effort involved in calculating wave field synthesis highly depends on the number of sound sources to be reproduced, on the reflection properties of a reproduction space, and on the number of loudspeakers. The larger the loudspeaker arrays, i.e. the more individual loudspeakers are provided, the better the possibilities of wave field synthesis may be exploited. However, what is disadvantageous is that the computing power that may be used increases as the number of individual loudspeakers used increases. For each virtual sound source, i.e. sound source to be reproduced, a corresponding signal may be calculated and transmitted for each individual loudspeaker of the loudspeaker array. In particular with moving virtual sources, the computing effort increases tremendously, so that conventional systems very quickly reach their limits because of the representation of moving sound waves, the limiting factor being the computing power.

A further known technique of spatial sound field reproduction is Ambisonic. This technique is based on a harmonic decomposition of the acoustic field along a spherical surface (3D) or along the circumference of a circle (2D). In the reproduction, a finite number of these harmonic portions is used for reproducing the original sound field at a point, the listening point. Depending on the number of harmonic portions used (referred to as order), the spatial extension of the area of optimum reconstruction of the sound field increases. In the simplest useful case ($1^{st}$ order), tone information is coded into four channels, which is also known by the synonym of Ambisonic B format. In this context, a channel contains a mono signal of the tone information. The three other channels contain the spatial components of the three spatial dimensions. These three signals are based on a harmonic decomposition of the acoustic field along a spherical surface, and reflect the instantaneous pressure distribution of the audio waves. This case is also the commercially most useful case because the four signals originally had to fit on a phonograph record as a competition of quadrophony. Currently, work is being done on preparing a specification which uses the medium of DVDs and accordingly allows more channels.

Ambisonic enables decomposing a spatial audio signal into the four channels described, and to recompose it accordingly. In this context, the signals relate to a reference point arranged in the middle of a sphere which has the corresponding loudspeakers located on its surface. The representation of spatial audio signals in accordance with the Ambisonic method therefore offers a less complex possibility of storing and reproducing spatial signals. However, what is disadvantageous about this technology is that spatial resolution and, therefore, the impression of stereophonic sound that may be achieved are limited.

As the Ambisonic order increases, results of similar quality as with WFS may indeed be achieved. However, the complexity also highly increases as a result, and there exists no microphone which exhibits the directional pattern of these higher harmonics. In this case, sophisticated microphone arrays will have to be used.

WFS reconstructs within a volume (or within an area), and it does so with a quality which is dependent on the expenditure implemented (e.g. LS distance).

Ambisonic indeed reconstructs in a precise manner, but it does so starting from one point, and on a comparatively large area as WFS, it does this only for very high orders.

However, both methods have a common theoretical basis, which is holophony.

The signals refer to a reference point at which a listener is ideally located, which accordingly complicates coverage of a relatively large area, such as a cinema or a concert hall.

In addition, it is a precondition that both the reproduction loudspeakers in relation to the listening point, and the virtual sound objects in relation to the reproduction loudspeakers be located sufficiently far apart, so that planar wave fronts may be assumed in any case.

In addition, further methods of representing spatial tone sources have been known from technology. For example, DTS (digital theatre system) is a digital multi-channel surround sound format.

Methods such as DTS, Dolby Surround, may also be regarded as encoding formats. In this manner, audio signals which are suited for 5.1 reproduction may be stored on a DVD, for example.

It is employed both in cinemas and on data media, for example DVDs. Reproduction ideally is effected via circularly arranged loudspeakers, in the center of which there is a reproduction space which is favorable for spatial sound reproduction and is also referred to as "sweet area". Dolby Digital signals, which are available in various variants, represent a further group of spatial sound signals. Apart from wave field synthesis, many audio formats have the disadvantage that only very limited spatial resolution and, thus, a limited spatial sound effect may be achieved. Wave field synthesis itself indeed offers spatial resolution, but said spatial resolution cannot be achieved, due to limited computing power, specifically in the case of several moving virtual tone sources, when, for example for consumer applications, cost factors also play a part with regard to the computing power available. In addition, Doppler artifacts result from the variable delay values of a moving audio source. Wave field synthesis is dependent on the computing expenditure, which in turn depends on the number of virtual audio sources, the number of rendering channels, the source movements, the filtering methods, the delay interpolation methods, etc.

As far as signal processing of Ambisonic Surround signals is concerned, Jerome Daniel, "Further Study of Sound Field Coding with Higher Order Ambisonics", presented at the AES 116$^{th}$ Convention, Berlin 2004, provides a good overview. An assessment of the quality of sound field reproduction by Ambisonic may be found in Martin Dewhirst, Slawomir Zielinski, Philip Jackson, Francis Rumsey: "Objective Assessment of Spatial Localisation Attributes of Surround-Sound Reproduction Systems", presented at the AES118$^{th}$ Convention, Barcelona 2005. Alois Sontacchi, Robert Höldrich, "Further Investigations on 3D Sound Fields using distance coding", presented at the Proceedings of the COST G-6 Conference on Digital Audio Effects, Limerick 2001, address the storage of spatial audio signals. WO 2005/015954 A2 and WO 02/08506 B deal with Ambisonic signals and describe spatial encoding with associated signal processing.

SUMMARY

According to an embodiment, an apparatus for generating a number of loudspeaker signals for a loudspeaker array which defines a reproduction space may have: a prestage configured to generate a plurality of output audio signals while using one or more virtual sources, a virtual source including one input audio signal, respectively, which is associated with a virtual position, each output audio signal being associated to a loudspeaker position specified by the prestage, and the prestage being configured such that the plurality of output audio signals together replicate a reproduction of the input audio signal(s) at the virtual position(s), and a number of output audio signals being smaller than a number of loudspeaker signals for the loudspeaker array; and a main stage configured to acquire the plurality of output audio signals and further to acquire, as a virtual position for each output audio signal, the loudspeaker positions specified by the prestage, and the main stage being configured to generate the number of loudspeaker signals for the loudspeaker array such that the loudspeaker positions specified by the prestage are replicated as virtual sources by the loudspeaker array.

According to another embodiment, a method of generating a number of loudspeaker signals for a loudspeaker array which defines a reproduction space may have the steps of: generating a plurality of output audio signals while using one or more virtual sources, a virtual source including one input audio signal, respectively, which is associated with one or more virtual positions, each output audio signal being associated to a loudspeaker position specified by a prestage, and the plurality of output audio signals together replicating the reproduction of the input audio signals at the virtual positions, and a number of output audio signals being smaller than a number of loudspeaker signals for the loudspeaker array; acquiring the plurality of output audio signals and the loudspeaker positions for each output audio signal; and generating the number of loudspeaker signals for the loudspeaker array, so that the loudspeaker positions specified by the prestage are replicated as virtual sources by the loudspeaker array.

According to another embodiment, a computer program may have a program code for performing the method of generating a number of loudspeaker signals for a loudspeaker array which defines a reproduction space, the method having the steps of: generating a plurality of output audio signals while using one or more virtual sources, a virtual source including one input audio signal, respectively, which is associated with one or more virtual positions, each output audio signal being associated to a loudspeaker position specified by a prestage, and the plurality of output audio signals together replicating the reproduction of the input audio signals at the virtual positions, and a number of output audio signals being smaller than a number of loudspeaker signals for the loudspeaker array; acquiring the plurality of output audio signals and the loudspeaker positions for each output audio signal; and generating the number of loudspeaker signals for the loudspeaker array, so that the loudspeaker positions specified by the prestage are replicated as virtual sources by the loudspeaker array, when the computer program runs on a computer or microcontroller.

The core idea of the present invention is the finding that for example by means of wave field synthesis, high spatial resolution may be achieved which may be exploited for simulating static virtual sound waves. The static virtual sound waves, in turn, may then be adapted to the respective audio format.

Advantageously, the properties of the virtual sound waves may be adapted to the reproduction format, so that the characteristics of point sources or plane waves may be utilized.

For example, a 5.1 audio signal, which is reproduced via five loudspeakers arranged, for example, on a circle, may be emulated by five simulated sound waves by means of wave field synthesis attending, for example, to a loudspeaker array of one hundred loudspeakers. In this manner, the advantages of wave field synthesis, that is the higher spatial resolution, and the advantages of other spatial audio signal processing methods, such as Ambisonic, for example, may be exploited. Therefore, by using the inventive method, several movable sources may be reproduced by means of wave field synthesis, it being possible for the computing expenditure to be kept constant for wave field synthesis, since said wave field synthesis only has to simulate static sources which go back to static filters.

One advantage of the inventive method also includes the selectable adaptation of the complexity of the calculations to the resources available in the reproduction.

BRIEF DESCRIPTION OF THE DRAWINGS

Embodiments of the present invention will be detailed subsequently referring to the appended drawings, in which.

DETAILED DESCRIPTION OF THE INVENTION

Figure 1:
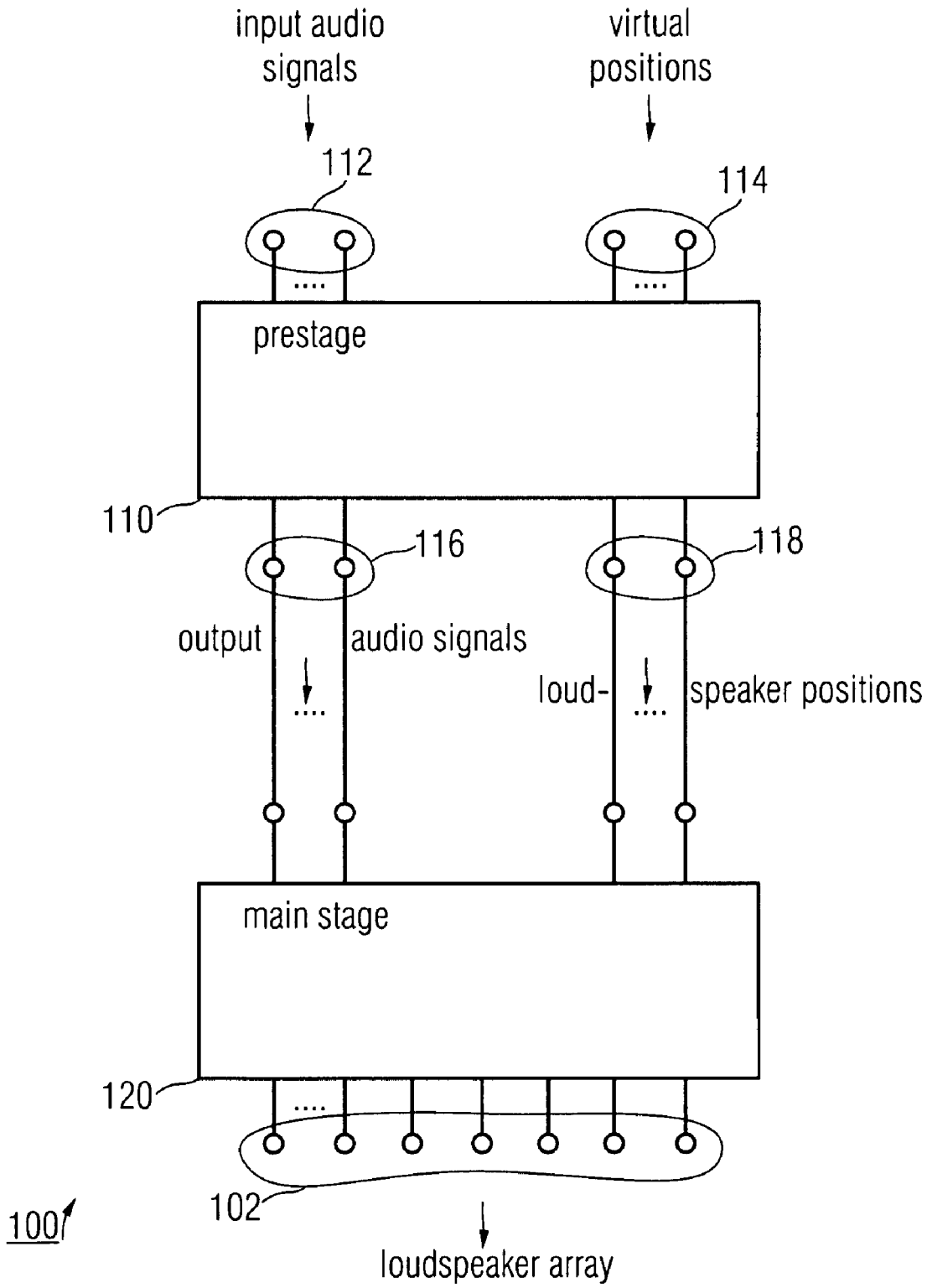
FIG. 1 shows an embodiment of the present invention.

FIG. 1 shows an apparatus 100 for generating a number of loudspeaker signals 102 for a loudspeaker array defining a reproduction space. The apparatus 100 comprises a prestage 110 configured to generate a plurality of output audio signals 116 while using one or more input audio signals 112 associated with one or more virtual positions 114, each output audio signal 116 being associated to a loudspeaker position 118 specified by the prestage 110, and the prestage 110 being configured such that the plurality of output audio signals 116 together replicate a reproduction of the input audio signal(s) 112 at the virtual position(s) 114, and a number of output audio signals 116 being smaller than a number of loudspeaker signals 102 for the loudspeaker array. The apparatus 100 further comprises a main stage 120 configured to obtain the plurality of output audio signals 116 and further to obtain, as a virtual position for each output audio signal 116, the loudspeaker positions 118 specified by the prestage 110, and the main stage 120 being configured to generate the number of loudspeaker signals 102 for the loudspeaker array such that the loudspeaker positions 118 specified by the prestage 110 are replicated as a virtual source by the loudspeaker array.

In one embodiment of the present invention, the main stage 120 is configured to generate, by means of wave field synthesis, the number of loudspeaker signals 102 and the specified loudspeaker positions 118 generated by the prestage 110. In this context, the loudspeaker array is controlled accordingly by the main stage 120. In this context, the specified loudspeaker positions 118 are generated in a static manner, or, in another embodiment, in a semi-static manner, such that positional changes in the loudspeaker positions 118 occur less frequently or more slowly than positional changes in the virtual positions 114.

This results in that only static sources and/or semi-static sources are generated by wave field synthesis. Consequently, the computing expenditure for wave field synthesis decreases considerably, wherein the representation of moving sources still may occur, by means of the upstream prestage 110, by controlling the output audio signals 116 accordingly.

In a further embodiment of the present invention, the main stage 120 is configured to emulate a virtual loudspeaker system which comprises fewer loudspeakers than the loudspeaker array. In this context, the virtual loudspeaker system may be emulated by point sources or by plane waves. If moving sources are to be simulated, this may be realized by adapting the output audio signals 116 by means of the prestage 110, it being possible for the loudspeaker positions 118 to be left unchanged.

In embodiments of the present invention, input audio signals 112 are feasible in various formats. In the embodiment shown in FIG. 1 it is assumed, by way of example, that the input audio signals 112 are made available to the prestage separately from their virtual positions 114. However, in accordance with the invention, any spatial audio formats are feasible, such as Ambisonic, Quadrophonic, Prologic, Prologic II, Dolby Digital, Dolby Digital EX, DTS, DTS-ES, SDDS (SDDS=sonic dynamic digital sound), THX, IMAX, etc. In accordance with the invention, the prestage 110 provides an image domain in an audio format via its input terminals, such as, in FIG. 1, the input audio signals 112 and the virtual positions 114. Said image domain is then mapped, by the inventive apparatus 100, to a real domain which corresponds to the loudspeaker array and to the loudspeaker signals 102 thereof. In this context, the prestage 110 converts the image domain to an intermediate domain which may be mapped to the real domain by the main stage 120 at low expenditure.

In a further embodiment, the inventive apparatus 100 may further be configured to obtain additional audio signals or additional positions, which are also mapped to the loudspeaker signals 102 and to the loudspeaker array, and whose formats may differ from the formats of the input audio signals 112. For example, it would be feasible to control static sources directly via wave field synthesis, and to make their virtual source positions and output audio signals available to the main stage 120 directly, whereas moving audio sources are controlled via the prestage 110. The loudspeaker array itself may be realized, for example, by a circular loudspeaker array. Generally, however, any forms of loudspeaker arrays are feasible, it being possible for the main stage 120 to be designed to map the random shapes of loudspeaker arrays to a virtual circle. This may occur, for example, by filtering the signals of the individual loudspeakers, such as by amplitude scaling and by means of delays per loudspeaker, for example. In this context, mention may also be made of irregular loudspeaker arrays which, in embodiments of the present invention, may be mapped to a virtual circular array, for example.

Figure 2:
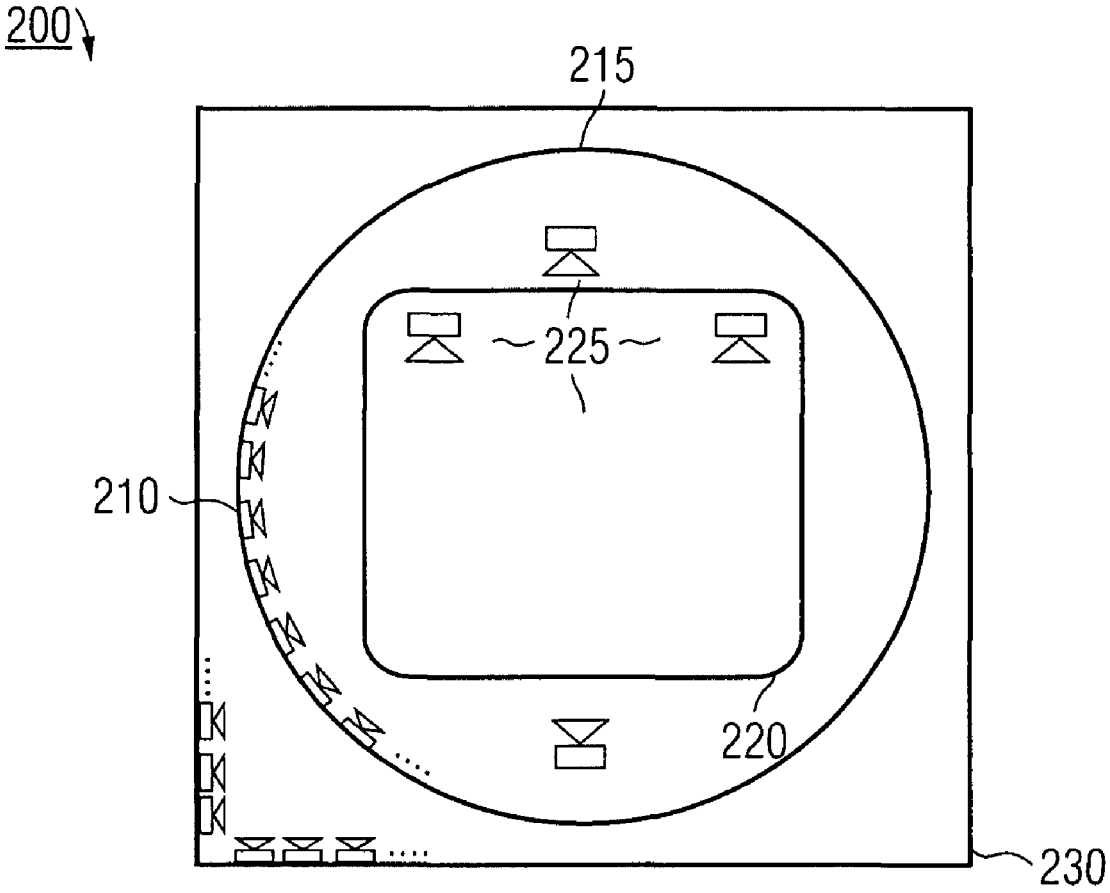
FIG. 2 shows a further embodiment of the present invention.

To further illustrate the present invention, FIG. 2 shows an embodiment of a cinema or concert hall 200. Initially, it shall be assumed that a loudspeaker array 210 be arranged on a circle 215. In this context, the loudspeaker array 210 encloses an auditorium 220 in which the audience is located during a show. Using the loudspeaker array 210, virtual sound waves 225 may be generated via wave field synthesis. These virtual sound waves 225 may be exploited at low expenditure, i.e. without the computing requirement of wave field synthesis, to generate a spatial sound experience for members of the audience in the auditorium 220.

In one embodiment of the present invention, wave field synthesis is utilized as a reproduction system having the known advantages. In this context, only static sources are represented using wave field synthesis, which results in that the disadvantages caused by source movement and by dynamic filters, for example, are eliminated. The computing expenditure of wave field synthesis is thereby kept constant to a large degree, possibly the number of virtual sources may be reduced. Thus, wave field synthesis provides a constant virtual loudspeaker system. Moving sources may be realized via the virtual loudspeaker system by means of a hybrid method, such as encoding movements in Ambisonic, 5.1, VBAP, etc.

Thus, transmission within an image domain is realized. A virtual sound source in wave field synthesis represents a loudspeaker of the virtual reproduction arrangement for the respective audio reproduction method to which the dynamic scene may be converted. These virtual loudspeakers may be reproduced, in wave field synthesis, as point sources or by plane waves. Depending on the degree of realness desired, or depending on the computing capacity available, an image domain, for example within the Ambisonic domain, may be scaled at the degree of representation. In the virtual loudspeaker system, the movement of a sound source occurs as a change in volume of the virtual loudspeakers. In one embodiment the running time of an original source may possibly be changed, for example directly in the original domain or, as is possible with higher-order Ambisonic, in the image domain. Generally, the format of the audio scenes is not subject to any restrictions. For example, a wave field synthesis scene from e.g. XMT-SAW could be encoded in accordance with Ambisonic or in any other multi-channel audio reproduction method, such as 5.1. What is characteristic about this hybrid method is a separation into two domains, the original and the image domains. This is equivalent to an independence in the scene production or encoding of the loudspeaker setting eventually used.

An advantageous conversion of WFS input data to Ambisonic data will be presented below. The starting point is the XML format. The individual sound events are encoded as objects. The following information is contained within the object descriptions: position of the .wav file with the audio signal of the source, period of existence of the source, and movement information of the source (position of the source with time stamps).

Encoding is then performed as follows: the position (distance and angle of incidence) of the sound source is calculated accurately per sample. Using this information, the Ambisonic signals may be directly calculated for simple Ambisonic and Ambisonic-WFS Hybrid. With Ambisonic comprising near-field encoding, the Ambisonic weight factors within the frequency space are calculated. With a window length enabling a high reproduction quality, only a sudden movement of the source is possible. However, by means of window overlap, the effect may be attenuated. In the calculation using the Ambisonic-WFS Hybrid method, the symmetry properties of Ambisonic are utilized to enable more efficient computation. With hybrid- and near-field-encoded Ambisonic it is to be noted that the Ambisonic signals are valid for a circle having a predefined radius, since the near-field effects both of the source and of the loudspeakers are taken into account in the computation.

In the reproduction of simple Ambisonic signals, no further effects need to be observed. Reproduction simply takes place via the Ambisonic player.

If the reproduction arrangement corresponds exactly to the assumptions in the encoding, the Ambisonic signals from the hybrid- and near-field-encoded methods may also be employed directly. If the reproduction arrangement does not match exactly, there are two possibilities: the near-field effects of the loudspeakers are precisely taken into account. In this context, the near-field effect, which was already assumed in the decoding, is taken into account. However, this method is costly.

The second possibility is an approximate solution. To this end, the signals of the loudspeakers are delayed and amplified according to their distance from the center of the circle. Simulations have shown that this approach provides results which are comparable to those of the first (precise) approach. The precondition for this is that the radius of the loudspeaker which is assumed for the encoding is in the order of magnitude of the radiuses of the reproduction loudspeakers (ideally, mean value).

Figure 4:
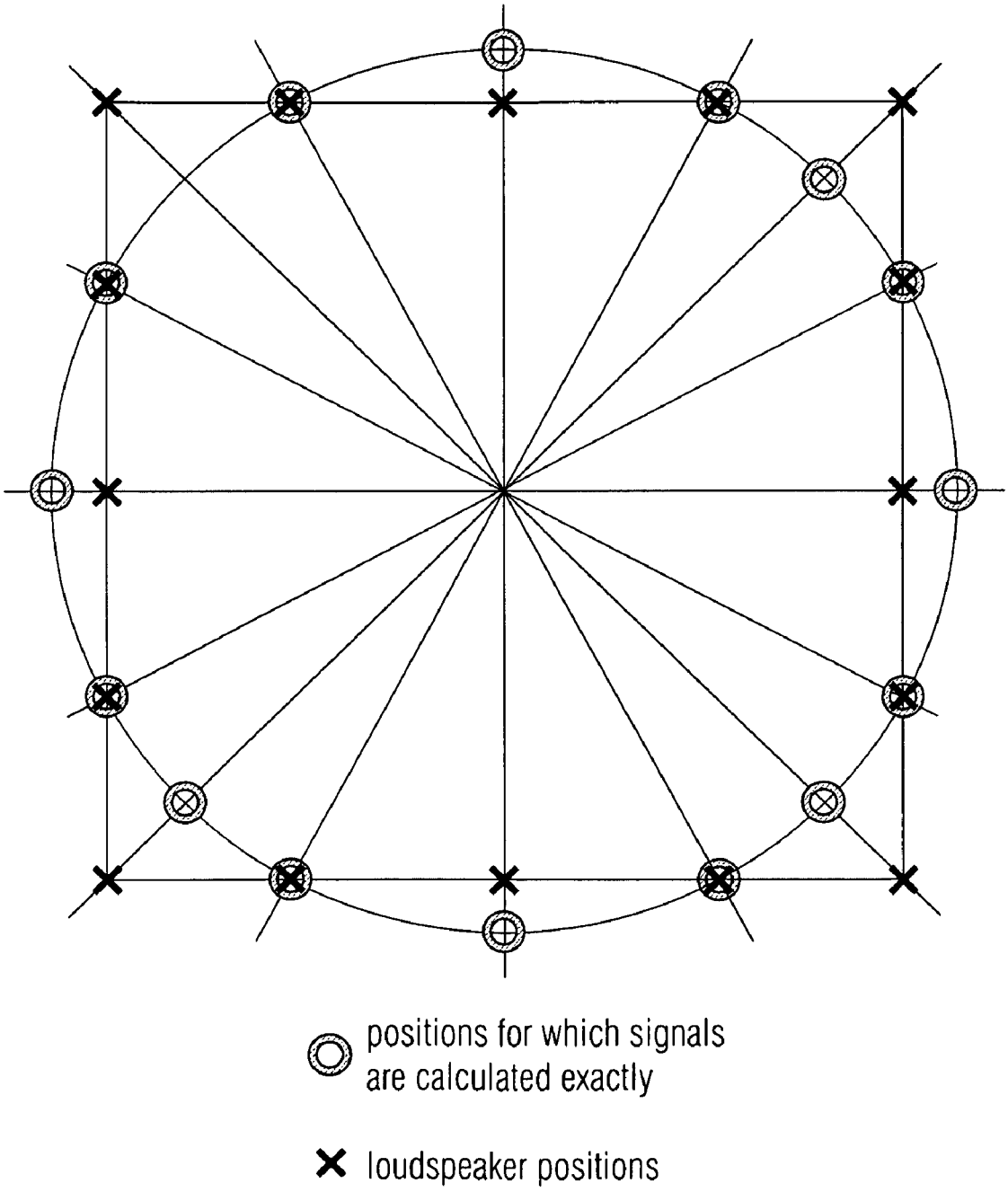
FIG. 4 shows an exemplary implementation of the approximate solution with loudspeakers outside a circle.

An advantageous arrangement of the circle is shown in FIG. 4. If the radius is placed such that sources are located within the radius, the signals would be attenuated in accordance with their distances from the center, and they would be "accelerated" as compared to the other loudspeakers, which may be achieved, for example, by delaying all other loudspeaker signals, so that the one non-delayed loudspeaker is accelerated as compared to the other loudspeakers.

Generally speaking, the prestage 110 is advantageously configured to map positional changes in the moving virtual positions 114 by adapting the output audio signals 116, and to leave the loudspeaker positions 118 unchanged, the adaptation comprising a delay or amplification of a loudspeaker component signal going back to a virtual source, the delay or amplification corresponding to a distance of a virtual source from an imaginary center of a circle on which the loudspeaker positions may be placed.

In this context it is advantageous to add, for each loudspeaker position, the loudspeaker component signals for the moving virtual sources after the respective delay or amplification in order to generate an adapted output audio signal.

For example, a change in the position of a source away from one loudspeaker and toward another loudspeaker results in that the component signal of the source for that loudspeaker from which the source was moved away will be delayed and slightly attenuated in dependence on the displacement, or the amount of the change in position. However, the component signal of the loudspeaker toward which the source was moved may be negatively delayed and slightly amplified in dependence on the displacement, or the amount of the change in position. If a negative delay is not possible, the signal cannot be changed, but all of the other signals may be changed, so that effectively, a negative delay, or "acceleration", of the one signal is achieved in relation to the other signals.

Embodiments of the present invention may also use non-circular or irregular loudspeaker arrangements. In this context, the signals are pre-filtered in accordance with their reproduction positions, i.e. their amplitudes and phases and ranges of sound are changed such that the distance of a loudspeaker from a virtual circle is compensated for. In this context, therefore, irregular loudspeaker arrangements are again mapped to a virtual circular loudspeaker arrangement. This effect is also illustrated in FIG. 2. If it is assumed that the cinema or the concert hall has a rectangular shape, as is indicated by 230, for example, embodiments of the present invention may map these non-regularly arranged loudspeakers to a virtual circle 215 in that the amplitudes of the corresponding signals are scaled, and in that their delays are adapted.

In this context, the way in which the Ambisonic signals, for example, have been obtained is irrelevant. In addition, embodiments of the present invention offer the possibility of adapting the ideal auditory range. This possibility is indirectly provided by the virtual sound sources, which in another embodiment are adaptable or semi-static.

Figure 3:
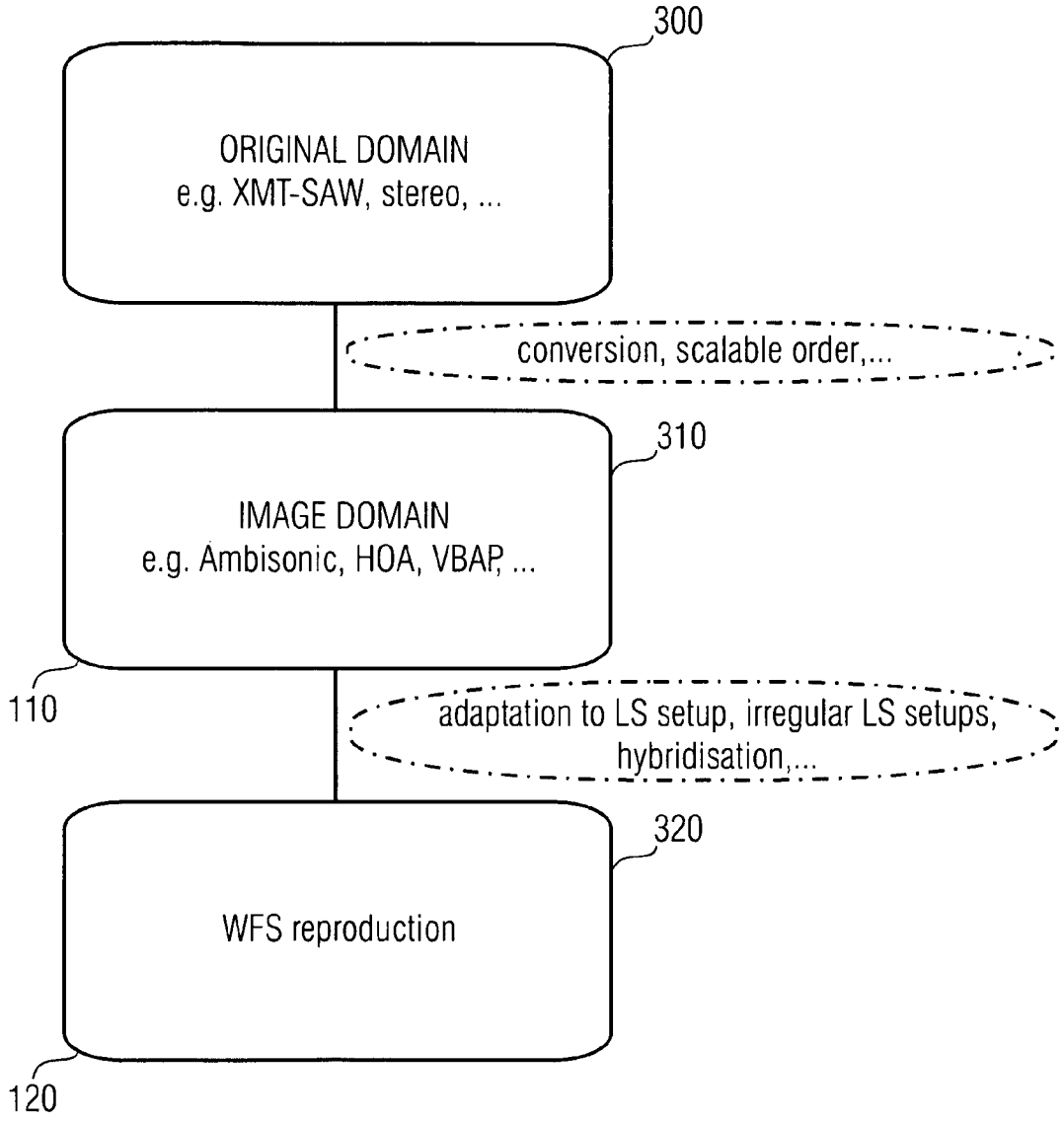
FIG. 3 is an illustration of an embodiment of the present invention.

FIG. 3 illustrates this method. FIG. 3 shows an original domain 300, an image domain 310, and a wave field synthesis reproduction 320. A stereo signal or a signal having any other spatial audio format is present in the original domain 300, for example. This signal may now be converted to an image domain, the order of the image domain being scalable depending on the audio format. The image domain 310 could be an Ambisonic signal, for example. Following FIG. 1, the image domain 310 is provided by the prestage 110. From the image domain 310, an adaptation to a loudspeaker setup is performed, wherein irregular loudspeaker setups are also taken into account, the audio signal is hybridized. The wave field synthesis reproduction 320 in FIG. 3 corresponds to the main stage 120 of FIG. 1, and eventually maps the image domain to a real domain, specifically to loudspeaker signals for a loudspeaker array.

The complexity, i.e. the computing expenditure, which may be employed for wave field synthesis may therefore be limited to a finite number of static filters. Thus, manifold problems of wave field synthesis which are associated with moving sound waves may be solved, such as the occurrence of Doppler artifacts and of temporal interpolation artifacts. The computing expenditure involved in wave field synthesis may therefore be kept nearly constant, and considerably lower than with comparable wave field synthesis rendering. Embodiments of the present invention thus offer the advantage that realization on DSP (digital signal processor) boards may be performed at considerably lower cost.

In order to realize wave field synthesis, the exact solution of a wave equation, for example, may be used for encoding. The signals of the original domain might result, for example, from the directional encoding in accordance with the classic Ambisonic theory, and from distance-dependent encoding. Distance encoding may be effected by filtering the Ambisonic signals of the individual orders. Near-field effects of the loudspeakers of the loudspeaker array and of the encoded sound sources may be combined, and thus the resulting Ambisonic signals may be kept limited. The filters employed for wave field synthesis are dependent both on the frequency of the input signal and on the distance between the loudspeakers and the reproduced sound source. Filtering may be performed in the frequency domain, and at a variable distance, floating windowing may be performed in the time domain, it being possible to adapt the filters accordingly if the distance is varied.

Calculating the near-field encoded Ambisonic signals by means of the hybrid approach provides a filter in the time domain which is automatically valid for all frequencies. Thus, it is also easily possible to take into account different distances of the sound sources reproduced, i.e. of the virtual sound sources. In addition, there is the possibility of prefiltering the signals so as to offset process-induced attenuations of high frequencies. In this case, higher frequencies may also be reproduced in a discrete manner so as to rule out any aliasing effects. Rotation matrices for Ambisonic may further be exploited to reduce the computing expenditure. As a result, the computing expenditure may be reduced to a quarter, in the two-dimensional case, or to an eighth, in the three-dimensional case, of the expenditure involved in direct computation.

Therefore, embodiments of the present invention offer the advantage that the computing expenditure of spatial audio signals may be reduced considerably, and that an adaptable system is realized.

It shall be pointed out, in particular, that the inventive scheme may also be implemented in software, depending on the circumstances. Implementation may be effected on a digital storage medium, in particular a disk or a CD having electronically readable control signals which may cooperate with a programmable computer system such that the respective method is performed. Therefore, the invention generally also consists in a computer program product having a program code, stored on a machine-readable carrier, for performing the inventive method, when the computer program product runs on a computer. In other words, the invention may therefore be realized as a computer program having a program code for performing the method, when the computer program product runs on a computer.

While this invention has been described in terms of several embodiments, there are alterations, permutations, and equivalents which fall within the scope of this invention. It should also be noted that there are many alternative ways of implementing the methods and compositions of the present invention. It is therefore intended that the following appended claims be interpreted as including all such alterations, permutations and equivalents as fall within the true spirit and scope of the present invention.

The invention claimed is:

1. An apparatus for generating a number of loudspeaker signals for a loudspeaker array which defines a reproduction space, the apparatus comprising:

a prestage configured to generate a plurality of output audio signals while using one or more virtual sources, a virtual source comprising one input audio signal, respectively, which is associated with a virtual position, each output audio signal being associated to a loudspeaker position specified by the prestage, and the prestage being configured such that the plurality of output audio signals together replicate a reproduction of the input audio signal(s) at the virtual position(s), and a number of output audio signals being smaller than a number of loudspeaker signals for the loudspeaker array; and a main stage configured to acquire the plurality of output audio signals and further to acquire, as a virtual position for each output audio signal, the loudspeaker positions specified by the prestage, and the main stage being configured to generate the number of loudspeaker signals for the loudspeaker array such that the loudspeaker positions specified by the prestage are replicated as virtual sources by the loudspeaker array.

2. The apparatus as claimed in claim 1, wherein the virtual sources employed by the prestage are moving virtual sources with variable positions, wherein the specified loudspeaker positions are static, and wherein the virtual positions corresponding to the specified static loudspeaker positions are static positions.

3. The apparatus as claimed in claim 1, wherein the prestage is configured to process all of the moving virtual sources of a number of virtual sources input comprising moving and static virtual sources, and wherein the main stage is configured to process only static virtual sources, wherein the static virtual sources comprise the virtual sources which are specified by the static loudspeaker positions, and additionally comprise the static virtual sources input.

4. The apparatus as claimed in claim 1, wherein the main stage is configured to generate, by means of wave field synthesis, the number of loudspeaker signals and the loudspeaker positions specified by the prestage.

5. The apparatus as claimed in claim 1, wherein the prestage is configured to statically or semi-statically generate the specified loudspeaker positions in such a manner that positional changes in the loudspeaker position occur less frequently or more slowly than positional changes in the virtual positions.

6. The apparatus as claimed in claim 1, wherein the main stage is configured to emulate a virtual loudspeaker system which comprises fewer loudspeakers than the loudspeaker array.

7. The apparatus as claimed in claim 6, wherein the virtual loudspeaker system is emulated by point sources or plane waves.

8. The apparatus as claimed in claim 1, wherein the prestage is configured to map positional changes in the virtual positions by adapting the output audio signals, and to leave the loudspeaker positions unchanged.

9. The apparatus as claimed in claim 8, wherein the prestage is configured to effect the adaptation of the output audio signals by means of a delay or amplification of a loudspeaker component signal going back to a virtual source, the delay or amplification corresponding to a distance of a virtual source from an imaginary center of a circle on which the loudspeaker positions may be placed.

10. The apparatus as claimed in claim 9, wherein the prestage is configured to add, for each loudspeaker position, the loudspeaker component signals for the moving virtual sources after the respective delay or amplification in order to generate an adapted output audio signal.

11. The apparatus as claimed in claim 1, wherein the prestage is configured to process input audio signals encoded in accordance with XMT-SAW, Open-AI 5.1, Ambisonic, Quadrophonic, Prologic, Prologic II, Dolby Digital, Dolby Digital-EX, DTS, DTS-ES, SDDS, 10.2, THX or IMAX.

12. The apparatus as claimed in claim 1, configured to provide, via the input audio signals and the virtual positions, an image domain which is mapped to an original domain via the loudspeaker signals and the loudspeaker array.

13. The apparatus as claimed in claim 1, wherein the main stage is configured to acquire additional audio signals or additional positions which are mapped to the loudspeaker signals and to the loudspeaker array, and the formats of which differ from the formats of the input audio signals.

14. The apparatus as claimed in claim 1, wherein the main stage is configured to control a circular loudspeaker array.

15. The apparatus as claimed in claim 1, wherein the main stage is configured to control an irregular loudspeaker array such that the individual loudspeaker signals are adapted to the irregular shape of the loudspeaker array.

16. The apparatus as claimed in claim 15, wherein the main stage is configured to perform the adaptation of the loudspeaker signals to the irregular loudspeaker array by individually delaying and amplifying the loudspeaker signals.

* * * * *

UNITED STATES PATENT AND TRADEMARK OFFICE

CERTIFICATE OF CORRECTION

PATENT NO. : 8,358,091 B2
APPLICATION NO. : 12/445150
DATED : January 22, 2013
INVENTOR(S) : Strauss et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 955 days.

Signed and Sealed this
First Day of September, 2015

Michelle K. Lee

Michelle K. Lee
*Director of the United States Patent and Trademark Office*